United States Patent [19]

Bertelsen

[11] 4,201,816

[45] May 6, 1980

[54] BASIS FOR A TABLETOP FOR AN EXTENSION TABLE

[76] Inventor: Henry F. Bertelsen, DK-6933, Kibaek, Denmark

[21] Appl. No.: 968,868

[22] Filed: Dec. 12, 1978

[30] Foreign Application Priority Data

Dec. 15, 1977 [DK] Denmark ..... 5588/77

[51] Int. Cl.[2] ..... B32B 3/10; A47B 1/10

[52] U.S. Cl. ..... 428/137; 108/66; 108/73; 428/131; 428/134

[58] Field of Search ..... 108/65, 66, 73; 428/134, 137, 64, 131

[56] References Cited

U.S. PATENT DOCUMENTS

| | | | |
|---|---|---|---|
| 535,212 | 3/1895 | Lattard | 108/66 X |
| 3,636,891 | 1/1972 | Bertelsen | 108/66 |
| 3,703,871 | 11/1972 | Bertelsen | 108/66 |
| 4,069,770 | 1/1978 | Bertelsen | 108/66 |

*Primary Examiner*—George F. Lesmes
*Assistant Examiner*—Alexander S. Thomas
*Attorney, Agent, or Firm*—Kenyon & Kenyon

[57] ABSTRACT

A basis for a tabletop for an extension table having extension leaves (E) with extension bars (B1 and B2), characterized by the fact that the tabletop basis consists of three laminae (10,20,30) having the same thickness and placed one on top of the other and are provided with various cut-out areas and slanting zones which together constitute cavities for slidably receiving extension bars of the extension leaves of the table.

2 Claims, 9 Drawing Figures

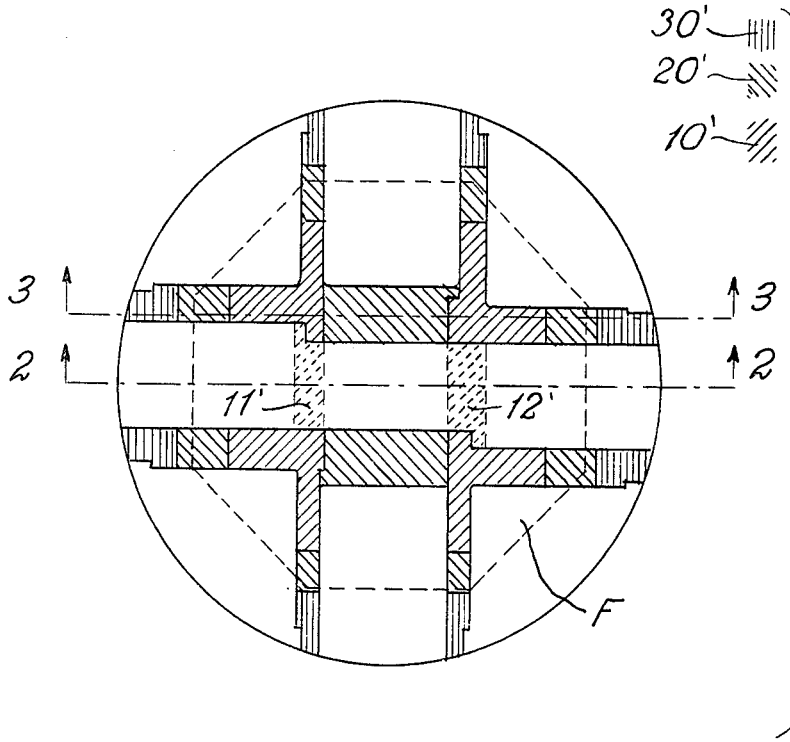
Fig. 1
Fig. 2
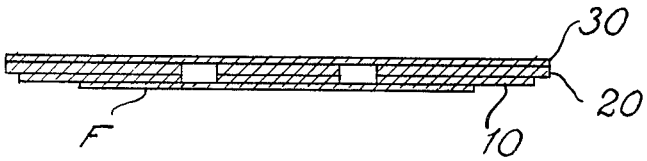
Fig. 3
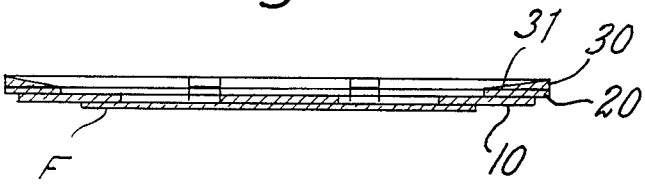

BASIS FOR A TABLETOP FOR AN EXTENSION TABLE

The purpose of the invention is to suggest a tabletop basis for a table of the above mentioned kind which tabletop basis, having no table frame in the literal sense of the word, is simple and therefore cheap to manufacture and which furthermore endows the finished table, of which it constitutes a part, with a considerable rigidity and strength.

The tabletop basis only needs to be supplemented with abutments for preventing the extension leaves from tilting down in a drawn-out position whereupon the tabletop basis is ready for receiving table legs, tabletop and extension leaves with extension bars.

The tabletop basis according to the invention is characterized by the fact that it consists of three laminae having the same thickness and placed one on the top of the other.

The upper lamina has two substantially symmetrically arranged portal-formed or pi-formed cut-out areas, having slanting zones near the periphery, the bottom lamina has two substantially symmetrically arranged portal-formed or pi-formed cut-out areas, turned 90° in comparison to the cut-out areas of the upper lamina, and the intermediate lamina has a cut-out area corresponding to the cut-out areas of those afore-mentioned laminae.

The cut-out areas and slanting zones together consistute cavities for slidingly receiving the extension bars of the table.

It will be seen that such tabletop basis is easy to manufacture and when supplemented with abutments and extension bars and tabletop and table legs will result in a good table which is cheap to manufacture and which has furthermore excellent rigidity and stability.

Figure 5:
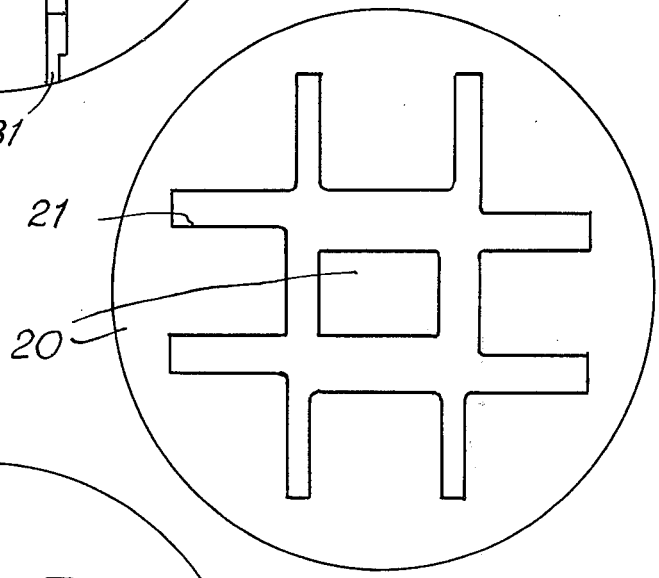
Figure 6:
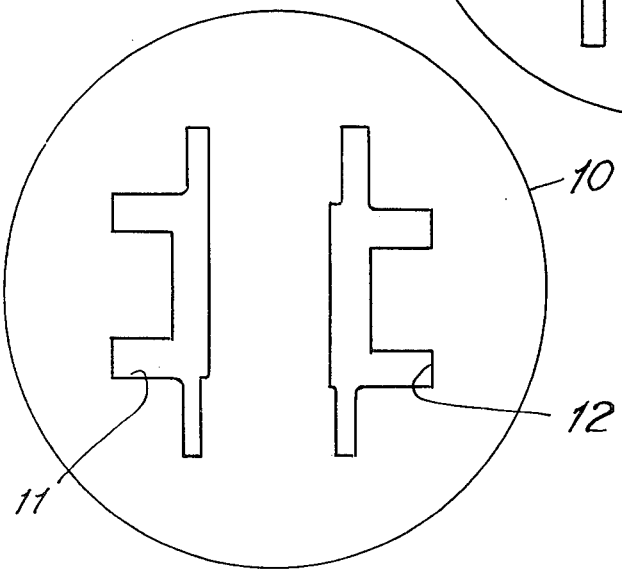
Figure 7:
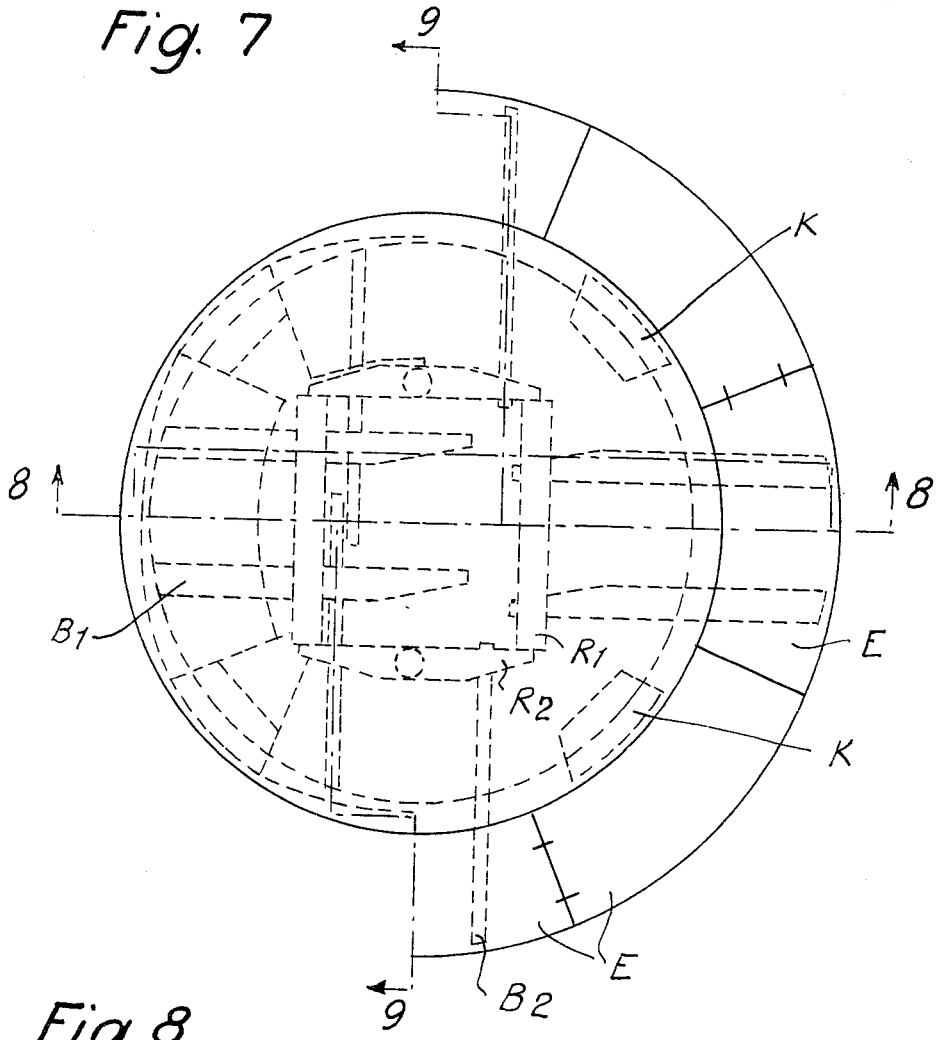
Figure 8:
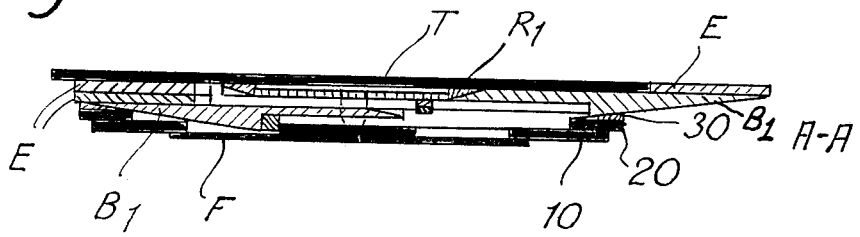
Figure 9:
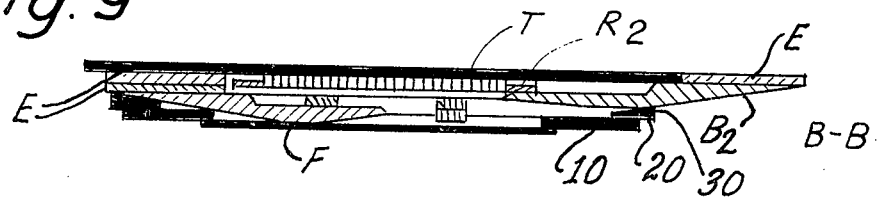

The invention will be further explained, reference being made to the drawing, in which FIG. 1 is a tabletop basis according to the invention for a circular extension table, FIG. 2 is a section along line 2—2 of FIG. 1, FIG. 3 is a section along line 3—3 of FIG. 1, FIGS. 4–6 the upper, the intermediate and the lower lamina, respectively, of the tabletop basis, FIG. 7 an extension table of which the tabletop basis according to FIGS. 1–6 constitutes a part, FIG. 8 the same in section along line 8—8 of FIG. 7, and FIG. 9 the same in section along line 9—9 of FIG. 7.

An extension table of which a tabletop basis 10,20,30 (FIGS. 1–6) according to the invention constitutes a part is shown in FIGS. 7,8 and 9, only the table legs not being shown in any of the figures.

The table, which has no table frame in the literal sense of the word, comprises—in addition to the tabletop basis 10,20,30 which will be further described below—a tabletop T and four sets of double-laying extension leaves E. In their drawn-out position each of these sets E cover, in their double-laying position, 45° of the table periphery and when the double-laying extension leaves have been swung out into a side-by-side position each set covers 90°.

The extension leaves are mounted on two different types of extension bars B1 and B2 (FIG. 7).

Above the tabletop basis 10,20,30 there are placed two types of abutments R1 and R2 which are intended for preventing the extension leaves with the extension bars B1 and B2 from tilting down in the drawn-out position.

Above the tabletop basis 10,20,30 there are furthermore four blocks K which are intended for filling the space between two adjacent sets of double-laying extension leaves E so that the table will look as if it had a continuous table frame.

Referring to FIGS. 1 to 3, the tabletop basis is constructed from three layers or laminae 10, 20, 30. In addition, a finishing slab F may be secured to the bottom of the lower laminae 10.

Figure 4:
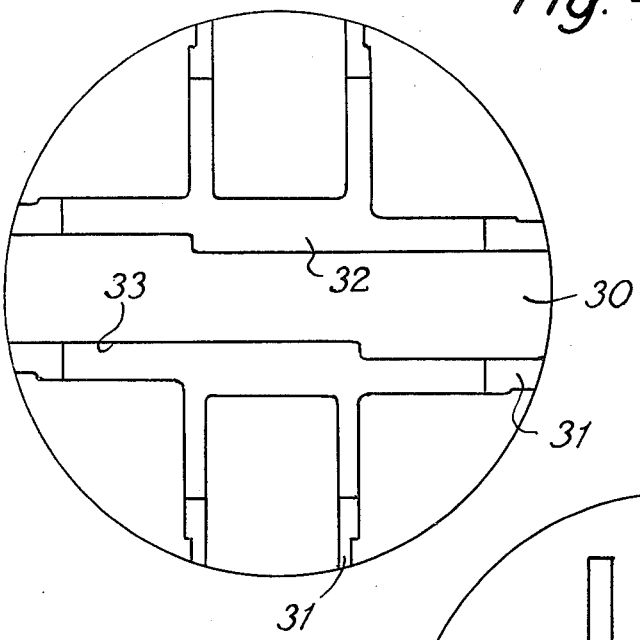

As shown in FIG. 4, the upper laminae 30 has two symmetrically placed cut-out areas 32, 33 of pi-form to define four pairs of parallel slots as well as pairs of cut-out zones 31 which extend from each pair of parallel slots. Each cut-out zone 31 has a bottom which slants inwardly of the lamina 30.

Referring to FIG. 6, the lower lamina 10 has two symmetrically arranged pi-formed cut-out areas 11, 12 turned 90° relative to the cut-out areas 32, 33 of the upper lamina 30.

As shown in FIG. 5, the intermediate lamina 20 has a cut-out area 21 corresponding to the cut-out areas 32, 33 of the upper lamina 30 and the cut-out areas 11, 12 of the lower lamina 10. With the lamina 10, 20, 30 in superposed relation the cut-out areas 11, 12, 21, 32, 33 define cavities for slidably receiving extension bars of extension leaves.

As shown in FIG. 1, the signature 10' indicates the cut-out areas 11, 12 in the lower lamina 10, the signature 20' indicates the cut-out area 21 when the cut-out areas 11, 12 are added and the signature 30' indicates the slanting cut-out zones 31. The cut-out area 21 is the projection of 11+12+32+33.

With a view to a pleasant look of the table the lower lamina 10 may have a smaller diameter than the two other laminae 20 and 30.

When the three laminae 10,20,30 are placed one on top of the other they will together constitute a tabletop basis having guides for the extension bars B1 and B2 shown in FIGS. 7–9.

A final table having good rigidity and stability is obtained when the tabletop basis 10,20,30 is supplemented with table legs or socle (not shown) and abutments R1 and R2, and, if desired, four blocks K and finally extension leaves E with extension bars B1 and B2 and a central tabletop T.

In lieu of three laminae 10,20,30 there may be used one lamina having double thickness and one thin lamina; or there may be used a single lamina having three-fold thickness, in the event cast in plastic material. The tabletop basis may also be manufactured of aluminium or another suitable material.

The invention is not limited to circular tables; the table may be oval or have any other shape.

I claim:

1. A tabletop basis of laminated construction comprising an upper lamina having two symmetrically placed cut-out areas of pi-form to define four pairs of parallel slots, and pairs of cut-out zones extending from each pair of parallel slots, each said cut-out zone having a bottom slanting inwardly of said lamina;

a lower lamina having two symmetrically arranged pi-formed cut-out areas turned 90° relative to said cut-out areas of said upper lamina; and an intermediate lamina having a cut-out area corresponding to said cut-out areas of said upper and lower lamina whereby with said laminae in superposed relation said cut-out areas of said laminae define cavities for slidably receiving extension bars of extension leaves.

2. A table top basis of three-fold thickness having two symmetrically placed cut-out areas of pi-form in an upper thickness to define four pairs of parallel slots and pairs of zones extending from each pair of parallel slots, each said zone having a bottom slanting inwardly of said tabletop basis;

two symmetrically arranged pi-formed cut-out areas in a lower thickness turned 90° relative to said cut-out areas of said upper thickness; and a cut-out area in an intermediate thickness corresponding to said cut-out areas of said upper and lower thickness whereby said cut-out areas of said thickness define cativities for slidably receiving extension bars of extension leaves.

* * * * *

UNITED STATES PATENT AND TRADEMARK OFFICE

CERTIFICATE OF CORRECTION

PATENT NO. : 4,201,816

DATED : May 6, 1980

INVENTOR(S) : Bertelsen, Henry F.

It is certified that error appears in the above—identified patent and that said Letters Patent is hereby corrected as shown below:

In the Specification:

Col. 1, line 4 - After the title, insert 3 paragraphs on page 1 of specification as follows:

The invention relates to a tabletop basis for an extension table having extension leaves with extension bars.

Normally an extension table having extension leaves and extension bars is constructed by means of a frame on which is arranged a system of sticks, which constitute the guides for the extension bars of the extension leaves, and abutments for preventing the extension bars from tilting down in drawn-out position.

However, a table frame is expensive to manufacture and the said sticks will have to be arranged very carefully by a man skilled in the art.

Col. 1, lines 58-59 - change "below" to be separated as "be-low" instead of --belo-w--

Signed and Sealed this

*Twenty-first* Day of *October 1980*

[SEAL]

*Attest:*

SIDNEY A. DIAMOND

*Attesting Officer*

*Commissioner of Patents and Trademark*